US009132892B2

(12) United States Patent
Lundin et al.

(10) Patent No.: US 9,132,892 B2
(45) Date of Patent: Sep. 15, 2015

(54) FLOATING VESSEL WITH TUNNEL

(71) Applicants: Henning Lundin, Gothenburg (SE); David Christer André, Gothenburg (SE)

(72) Inventors: Henning Lundin, Gothenburg (SE); David Christer André, Gothenburg (SE)

(73) Assignee: GVA Consultants AB, Gothenburg (SE)

( * ) Notice: Subject to any disclaimer, the term of this patent is extended or adjusted under 35 U.S.C. 154(b) by 0 days.

(21) Appl. No.: 14/099,189

(22) Filed: Dec. 6, 2013

(65) Prior Publication Data

US 2015/0158557 A1 Jun. 11, 2015

(51) Int. Cl.

| | |
|---|---|
| ***B63B 25/12*** | (2006.01) |
| ***B63B 25/16*** | (2006.01) |
| ***B63B 25/08*** | (2006.01) |
| ***B63B 35/44*** | (2006.01) |

(52) U.S. Cl.

CPC ..... *B63B 25/08* (2013.01); *B63B 25/12* (2013.01); *B63B 25/16* (2013.01); *B63B 35/44* (2013.01)

(58) Field of Classification Search

CPC ..... B63B 25/16; B63B 25/12
USPC ..... 114/74 A, 74 T, 74 R
See application file for complete search history.

(56) References Cited

U.S. PATENT DOCUMENTS

| | | | | | |
|---|---|---|---|---|---|
| 3,145,854 | A | * | 8/1964 | Sturm et al. | 14/71.1 |
| 3,425,583 | A | * | 2/1969 | Bridges | 220/560.05 |
| 3,680,323 | A | * | 8/1972 | Bognaes et al. | 62/53.2 |
| 3,766,875 | A | * | 10/1973 | Baki | 114/73 |
| 3,770,158 | A | * | 11/1973 | Alleaume | 220/560.03 |
| 3,841,253 | A | * | 10/1974 | Kircik et al. | 114/74 R |
| 3,974,792 | A | * | 8/1976 | Burnell et al. | 114/144 B |
| 4,000,711 | A | * | 1/1977 | Okamoto et al. | 114/74 A |
| 4,086,864 | A | * | 5/1978 | Ito | 114/74 A |
| 4,090,460 | A | * | 5/1978 | Nishimaki et al. | 114/74 A |
| 4,546,719 | A | * | 10/1985 | Collins et al. | 114/40 |
| 5,313,903 | A | * | 5/1994 | Goldbach et al. | 114/65 R |
| 5,477,797 | A | * | 12/1995 | Stuart | 114/65 R |
| 5,483,910 | A | * | 1/1996 | Skaarub et al. | 114/71 |
| 5,545,063 | A | * | 8/1996 | Haynes | 440/47 |
| 5,577,454 | A | * | 11/1996 | Goldbach | 114/65 R |
| 6,041,726 | A | * | 3/2000 | Filek | 114/74 R |
| 6,125,778 | A | * | 10/2000 | Rodden | 114/74 R |
| 6,761,123 | B2 | * | 7/2004 | Husain et al. | 114/74 R |
| 6,869,540 | B2 | * | 3/2005 | Robinson et al. | 210/760 |
| 6,997,132 | B2 | * | 2/2006 | Steen | 114/265 |
| 7,311,054 | B2 | * | 12/2007 | Noble et al. | 114/74 R |
| 7,524,387 | B2 | * | 4/2009 | Kennedy | 156/94 |
| 8,381,670 | B2 | * | 2/2013 | Willen et al. | 114/264 |
| 8,499,569 | B2 | * | 8/2013 | Van Tassel | 62/48.2 |
| 2005/0217554 | A1 | | 10/2005 | Steen | |
| 2007/0062430 | A1 | | 3/2007 | Noble et al. | |
| 2009/0293506 | A1 | | 12/2009 | Ryu et al. | |
| 2010/0206213 | A1 | | 8/2010 | Kullander et al. | |
| 2011/0041753 | A1 | | 2/2011 | Willen et al. | |

* cited by examiner

FOREIGN PATENT DOCUMENTS

| | | |
|---|---|---|
| WO | 2010/028240 A2 | 3/2010 |
| WO | 2012/016295 A1 | 2/2012 |

*Primary Examiner* — Lars A Olson
*Assistant Examiner* — Jovon Hayes
(74) *Attorney, Agent, or Firm* — Gary M. Machetta

(57) ABSTRACT

Herein a floating vessel is disclosed. The floating vessel comprises a body structure, a tank for at least temporarily storing a liquid, and at least one pipe connected to the tank. The floating vessel further comprises a tunnel having a first end portion and a second end portion extending through the body structure. The tunnel is arranged in open connection to an ambient environment of the floating vessel. There is least one pipe connected to the tank extending at least partially through the tunnel.

20 Claims, 4 Drawing Sheets

FLOATING VESSEL WITH TUNNEL

TECHNICAL FIELD

Embodiments disclosed herein relate to a floating vessel.

BACKGROUND

Some floating vessels comprise one or more tanks for storing a liquid. For instance a liquefied hydrocarbon gas, such as LNG (Liquefied Natural Gas) or LPG (Liquefied Petroleum Gas) may be stored aboard a floating vessel.

WO 2010/028240 and US 2007/062430 disclose a liquid containment system for a seafaring vessel. The liquid containment system includes a tank having an at least partially non-planar upper portion. The upper portion of the tank contains a substantial portion of the liquid therein and reduces the free surface area associated with the liquid. The upper portion of the tank extends above the horizontal deck of the vessel, but still allows sufficient deck space for supporting various required equipment. In one embodiment, the liquid containment system is a membrane tank designed to receive and hold liquefied natural gas ("LNG").

WO 2012/016295 discloses a gaseous fuel powered marine vessel. The vessel comprises at least two hulls and a portion disposed between the two hulls, a propulsion system operable using a gaseous fuel, and a storage means for containing a supply of gaseous fuel for a propulsion system, the storage means being accommodated in the portion between the two hulls. The storage means is placed in the marine vessel a significant distance aft from the bow and close to the vessel bottom.

US 2011/041753 discloses a semi-submersible offshore platform body for supporting drilling, storing, treatment or production of hydrocarbons at sea. The platform body has a cross section with a centre point in a first plane, and is defined by a side wall formed by at least one hollow side wall section. Inside the side wall section there are arranged storage tanks for storing e.g. LNG.

US 2009/293506 discloses a semi-submersible offshore structure having storage tanks for liquefied gas, which is constructed so as to improve workability in marine offloading of the liquefied gas stored in the storage tanks while reducing an influence of sloshing. The offshore structure is anchored at sea. The offshore structure includes storage tanks for storing liquefied gas, a plurality of columns partially submerged under the sea level, and an upper deck located on the plurality of columns to connect the columns to each other. The storage tanks are arranged in the columns.

Liquids of various kinds have to be transferred to and/or aboard a floating vessels.

SUMMARY

It is an object to provide an arrangement for transferring a liquid to and/or aboard a floating vessel.

According to an aspect, this is achieved by a floating vessel comprising a body structure, a tank for at least temporarily storing a liquid, and at least one pipe connected to the tank, wherein the floating vessel further comprises a tunnel having a first end portion and a second end portion extending through the body structure. The tunnel is arranged in open connection to an ambient environment of the floating vessel with the tunnel having a first opening at the first end portion and at a first side portion of the body structure, and a second opening at the second end portion and at a second side portion of the body structure. The at least one pipe connected to the tank extends at least partially through the tunnel.

Since the tunnel extends through the body structure and the at least one pipe connected to the tank extends at least partially through the tunnel, a liquid may be directed to and/or from the tank through the pipe in the tunnel. Thus, a dedicated space for conducting liquid is provided by the tunnel. Moreover, since the tunnel is arranged in open connection to an ambient environment of the floating vessel, the tunnel is considered an area ventilated to the ambient environment, i.e. similar to that of an upper deck of the floating vessel. If flammable or in other ways hazardous liquids are conducted through the at least one pipe, this may be an advantageous aspect in the hazardous area classification of the tunnel.

The floating vessel may for instance be a ship or a semi-submersible offshore platform. Thus, the body structure may comprise the hull of a ship, or a deck structure of a semi-submersible offshore platform. The first and second side portions of the body structure may be first and second lateral side portions of the floating vessel. It is also foreseen that the first and second side portions of the body structure may be upper and lower side portions of the floating vessel, or a lateral side portion and an upper or a lower side portion of the floating vessel. An opening in a lower side portion may for instance be provided in a deck structure of a semi-submersible offshore platform. The tank may be foreseen to be a liquefied gas fuel tank for a gas consumer aboard the floating vessel. However, the tank may alternatively be a tank for storing liquefied gas or other liquid aboard a production vessel or a transport vessel. According to embodiments, the tank may be adapted for at least temporarily storing liquefied hydrocarbon gas such as LNG. In this manner the above mentioned advantage of the tunnel forming a ventilated area may be utilized.

According to embodiments, the floating vessel may comprise a further tank for at least temporarily storing a liquid and at least one pipe connected to the further tank, wherein the at least one pipe connected to the further tank extends through the tunnel. Since the tunnel is open at both ends via the first and second openings, both the tank and the further tank may be reached from both ends of the tunnel. This may be advantageous for instance when feeding liquid from a bunkering station to the tank and the further tank, which feeding to both tanks thus, may take place from one side only of the floating vessel.

According to embodiments, the floating vessel may comprise an engine and/or other gas consumer and a pipe leading from the tank to the engine and/or the other gas consumer, wherein the pipe leading from the tank to the engine and/or the other gas consumer may extend through the tunnel. Again, the above mentioned advantages of conducting pipes through the tunnel are again applicable.

According to embodiments, the tank may be a dedicated fuel tank for the engine and/or the other gas consumer. The engine may be an engine for directly or indirectly propelling the floating vessel and/or an engine for driving an electric generator. Examples of other gas consumers are for instance an incinerator, a boiler, and a fuel cell. A dedicated fuel tank is a tank, the entire contents of which are used as a fuel for the engine and/or the other gas consumer.

According to embodiments, the tunnel may comprise an inclined surface arranged beneath the at least one pipe in the tunnel, the inclined surface may be inclined downwardly towards the first end portion and/or the second end portion of the tunnel. In this manner any liquid leaking out of the pipes in the tunnel may be directed to an end portion of the tunnel.

From the end portion of the tunnel the liquid may be directed overboard. Thus, it may be ensured that the liquid does not damage the floating vessel.

According to embodiments, the floating vessel may comprise a bunkering station for filling the tank and the further tank, the bunkering station may be arranged in vicinity of the first end portion of the tunnel, wherein the at least one pipe connected to the further tank is connected to the bunkering station. In this manner liquid may be fed from the bunkering station to both tanks.

According to embodiments, the floating vessel may comprise a further bunkering station for filling the tank and the further tank, the further bunkering station being arranged in vicinity of the second end portion of the tunnel, wherein the at least one pipe connected to the tank is connected to the further bunkering station. In this manner liquid may be fed from the further bunkering station to both tanks.

If the floating vessel comprises both a bunkering station and a further bunkering station as discussed above, a high degree of flexibility and convenience for feeding liquid to the tank and the further tank may be achieved.

According to embodiments, the body structure may comprises a deck member, wherein the tank may extend through the deck member, and wherein the tank may be supported by the deck member. In this manner a convenient way of arranging the tank in the floating vessel may be achieved. Suitably, pipes connected to the tank may be connected to a top end portion of the tank.

According to embodiments, an upper side of the deck member in a space adjacent to the tank may be contiguous with an ambient environment of the floating vessel, wherein the tunnel may connect to the space adjacent to the tank. In this manner the area where pipes are connected to the tank may be naturally ventilated. Thus, the hazardous area classification may be positively affected. An alternative would be to provide a closed space around the upper side of the deck member adjacent to the tank, and to provide forced ventilation of this space.

According to embodiments, the deck member may form a lower deck of the floating vessel, above which lower deck at least one higher level deck extends. Since the tank extends through the deck member, the tank is protected by the higher level deck/s from heavy falling objects. The term lower deck entails any deck arranged below a deck and thus, encompasses other decks than the lowest deck of a floating vessel.

According to some embodiments, the floating vessel may be a semi-submersible offshore platform comprising one or more submersible pontoons and at least a first and a second column, wherein the body structure may comprise a deck structure adapted to be arranged above a water surface. The first and second columns may be connected to the one or more submersible pontoons and the deck structure, and the tunnel may extend through the deck structure. According to some embodiments the first and second columns may support the deck structure above the water surface. According to some embodiments, the semi-submersible offshore platform may be a heavy lift unit, a drilling unit, an accommodation unit, a production unit, or a well intervention unit.

According to embodiments, the tank may be at least partially arranged in the first column.

According to embodiments, the further tank may be at least partially arranged in the second column.

Further features and advantages will become apparent when studying the appended claims and the following detailed description.

BRIEF DESCRIPTION OF THE DRAWINGS

Various aspects of embodiments, including their particular features and advantages, will be readily understood from example embodiments discussed in the following detailed description and accompanying drawings, in which.

DETAILED DESCRIPTION

Aspects of example embodiments will now be described more fully. Like numbers refer to like elements throughout. Well-known functions or constructions will not necessarily be described in detail for brevity and/or clarity.

Figure 1:
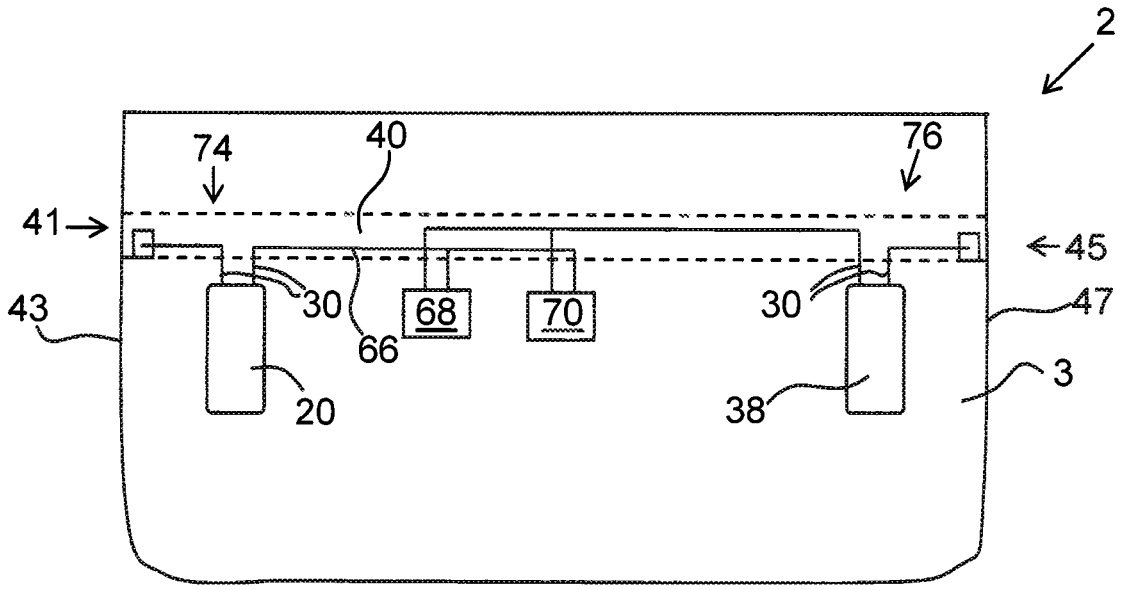
FIG. 1 schematically illustrates a cross section through a floating vessel according to embodiments, FIGS. 2 and 3 schematically illustrate a side view cross section and a top view cross section of a floating vessel according to embodiments, FIG. 4 schematically illustrates a partial side view cross section of a floating vessel according to embodiments, and FIG. 5 schematic illustrates a front view cross section of embodiments of a floating vessel in the form of a semi-submersible offshore platform.

FIG. 1 schematically illustrates a cross section through a floating vessel 2 according to embodiments. The floating vessel 2 comprises a body structure 3. In these embodiments the floating vessels 2 is a ship and the body structure 3 comprises the hull of a ship. The floating vessel 2 further comprises a tank 20 for at least temporarily storing a liquid, and at least one pipe 30 connected to the tank 20. The floating vessel 2 further comprises a tunnel 40 having a first end portion 74 and a second end portion 76 extending through the body structure 3, e.g. extending between starboard and port sides of the ship. The tunnel 40 is arranged in open connection to an ambient environment of the floating vessel 2. The tunnel 40 has a first opening 41 at the first end portion 74 and a first side portion 43 of the body structure 3. The tunnel 40 has a second opening 45 at the second end portion 76 and a second side portion 47 of the body structure 3. The at least one pipe 30 connected to the tank 20 extends at least partially through the tunnel 40. The tank 20 is adapted for at least temporarily storing liquefied hydrocarbon gas, such as LNG.

The floating vessel 2 comprises a further tank 38 for at least temporarily storing a liquid and at least one pipe 30' connected to the further tank 38. The at least one pipe 30' connected to the further tank 38 extends through the tunnel 40. Also the further tank 38 may be adapted for at least temporarily storing liquefied hydrocarbon gas, such as LNG.

The floating vessel comprises an engine 68 and/or other gas consumer 70 and a pipe 66 leading from the tank 20 to the engine 68 and/or the other gas consumer 70. The pipe 66 leading from the tank 20 to the engine and/or the other gas consumer extends through the tunnel 40. The tank 20 is a dedicated fuel tank for the engine 68 and/or the other gas consumer 70.

Figure 2:
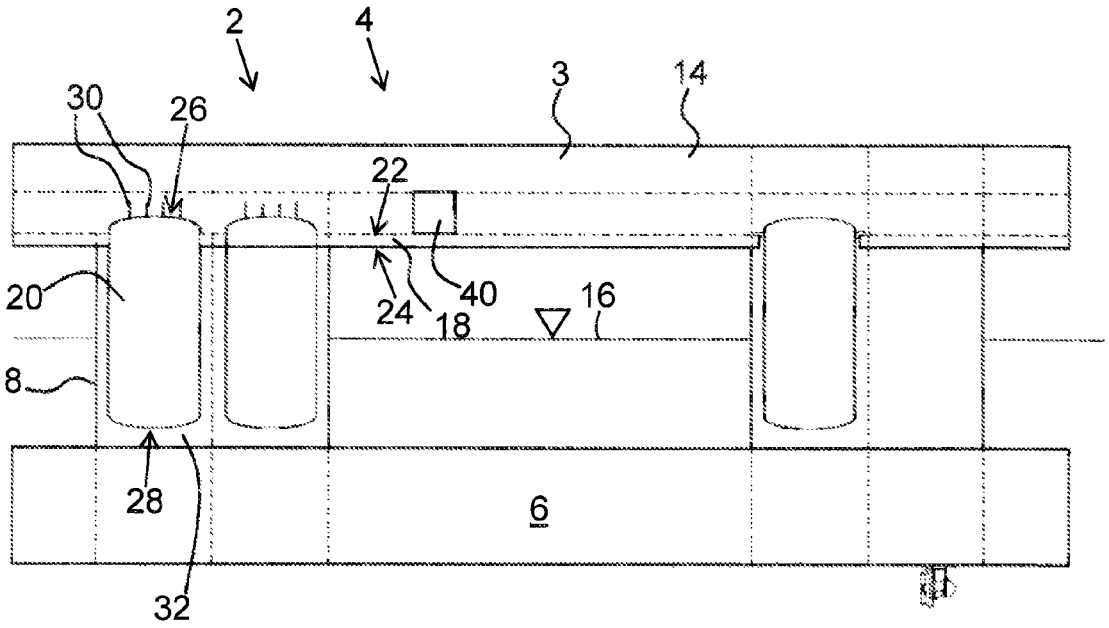
Figure 3:
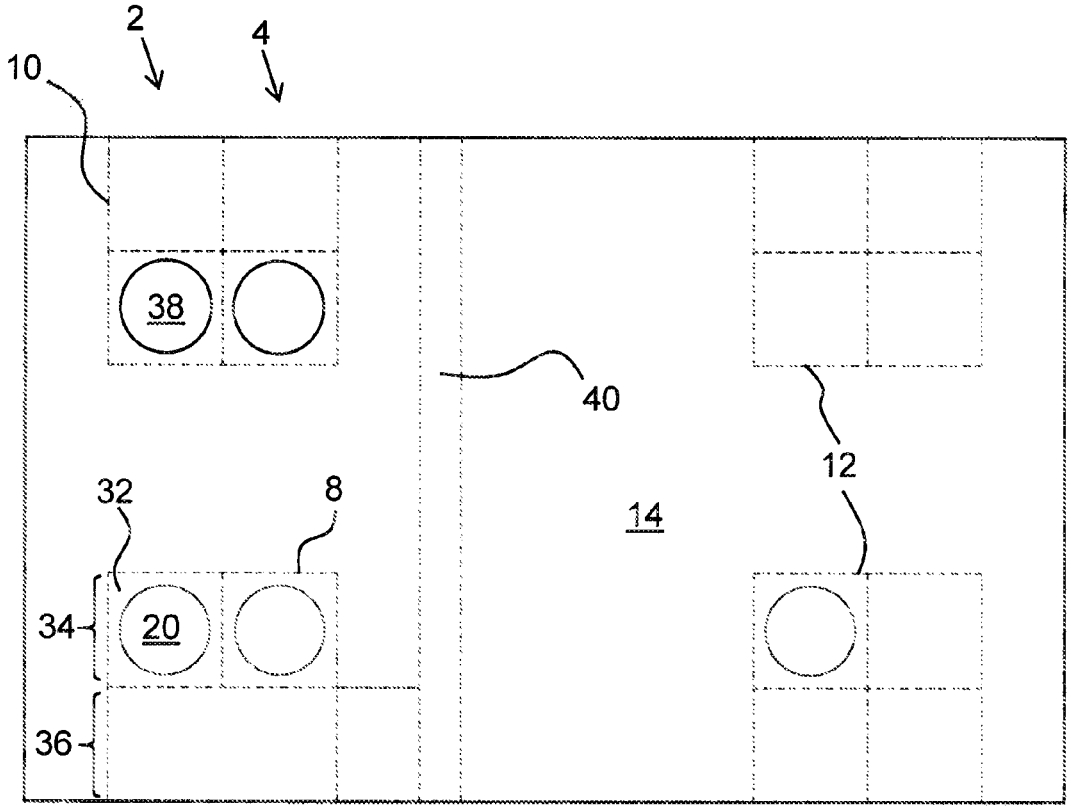

FIGS. 2 and 3 schematically illustrate a side view cross section and a top view cross section of a floating vessel 2 according to embodiments. The floating vessel 2 is a semi-submersible offshore platform 4 comprising one or more submersible pontoons 6, a first column 8, a second column 10, and two more columns 12. The semi-submersible offshore platform 4 further comprises a body structure 3 comprising a deck structure 14 adapted to be arranged above a water surface 16. Depending on the use of the semi-submersible offshore platform 4, various equipment may be arranged atop the upper deck of the deck structure 14. The columns 8, 10, 12 are connected to the one or more submersible pontoons 6. The columns 8, 10, 12 are connected to, and support, the deck structure 14 above the water surface 16. The deck structure 14 comprises a deck member 18. The deck member 18 may be an ordinary deck, or a deck unit comprising one or more sealed compartments which may form a floating aid in case the semi-submersible offshore platform 4 should it capsize.

The floating vessels 2 comprises a tank 20 for liquefied hydrocarbon gas. During use of the floating vessel 2, i.e. as illustrated in FIG. 2, the deck member 18 comprises an upper side 22 facing upwardly, a lower side 24 facing downwardly, and the tank 20 comprises a top 26 and a bottom 28. The tank 20 extends through the deck member 18. The tank 20 is supported by the deck member 18 and the tank 20 is suspended at less than ⅓ of a total height of the tank 20 from the top 26 of the tank 20.

At least one pipe 30 is connected to the tank 20 above the upper side 22 of the deck member 18. The at least one pipe 30 may be a pipe for conducting liquefied gas or gas to, and/or from, the tank 20. Pipe connections to, and/or from, the tank 20 are entirely omitted below the deck member 18. The tank 20 is arranged in a dedicated tank compartment 32 underneath the deck member 18. The deck member 18 forms an upper limitation of the tank compartment 32. The tank 20 comprise a self-supporting tank structure. The tank 20 may for instance be designed to withstand an internal pressure of 10 bar. The tank 20 is elongated and has a longitudinal axis. The longitudinal axis is arranged substantially vertically in the floating vessel.

The tank 20 is arranged in the first column 8. The first column 8 comprises at least a first portion 34 and a second portion 36. The first portion 34 is arranged closer to the second column 10 than the second portion 36. The tank 20 and the compartment 32 are arranged in the first portion 34. Thus, the tank 20 is arranged towards a middle portion of the semi-submersible offshore platform. Accordingly, should the first column 8 be damaged from a sea side direction, it is the second portion 36 without the tank 20 that takes the main impact.

The floating vessel 2 comprises a further tank 38 for liquefied gas. The further tank 38 is arranged in the second column 10. In these embodiments additional tanks are provided in the columns 8, 10, 12, in total five tanks are provided. Less or more tanks may be provided in alternative embodiments.

The floating vessel 2 comprises a tunnel 40 extending through the deck structure 14. The tunnel 40 is arranged in open connection to an ambient environment of the floating vessel 2. Pipes (not shown) leading to and/or from the tank 20 and the further tank 38 extend through the tunnel 40.

Figure 4:
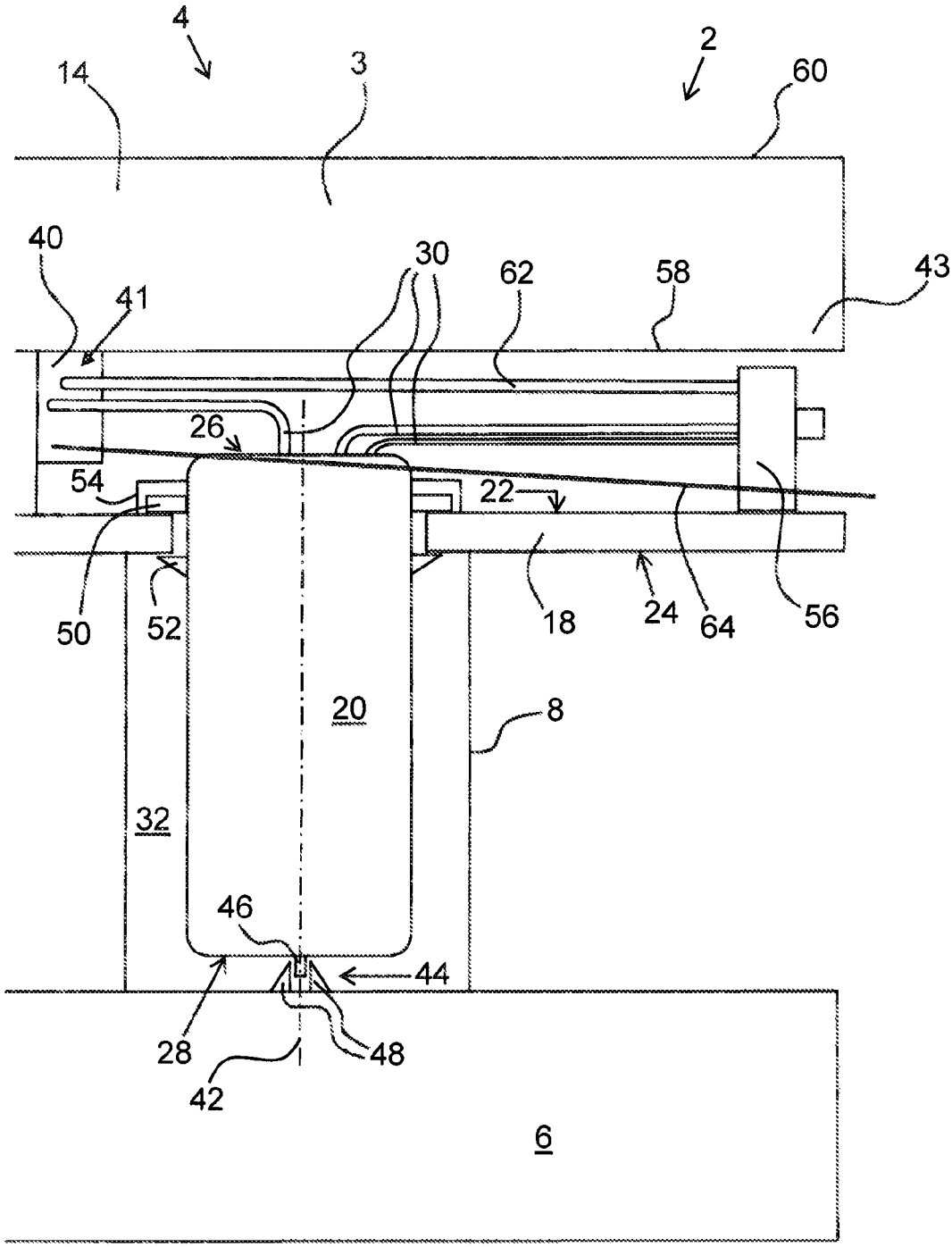

FIG. 4 schematically illustrates a partial side view cross section of a floating vessel 2 according to embodiments. The floating vessel 2 comprises a deck member 18 and a tank 20 for liquefied hydrocarbon gas. During use of the floating vessel 2, as illustrated in FIG. 4, the deck member 18 comprises an upper side 22 facing upwardly, a lower side 24 facing downwardly. In the same position of the floating vessel 2 the tank 20 comprises a top 26 and a bottom 28. The tank 20 extends through the deck member 18. The deck member 18 may be a deck unit comprising one or more sealed compartments. Alternatively, the deck member may be in an ordinary deck. The tank 20 is supported by the deck member 18. Substantially the entire weight of the tank 20 is supported by the deck member 18. The tank 20 is suspended at less than ⅓ of a total height of the tank 20, seen from the top 26 of the tank 20.

The tank 20 may be suspended at less than ⅕ of a total height of the tank 20, seen from the top 26 of the tank 20. The tank 20 may be suspended at approximately 1/10 of a total height of the tank 20, seen from the top 26 of the tank 20. Mentioned purely as an example, the tank 20 may have a total height of approximately 20 meters and the tank 20 may be suspended at approximately 2 meters from the top 26 of the tank 20.

The tank 20 comprises a self-supporting tank structure. The tank 20 is elongated and has a longitudinal axis 42. The longitudinal axis 42 is arranged substantially vertically in the floating vessel 2. The tank 20 is arranged in a dedicated tank compartment 32 underneath the deck member 18. The dedicated tank compartment 32 is delimited by sidewalls, a floor, and the deck member 18. A guide arrangement 44 is arranged between the compartment 32 and a bottom end portion of tank 20. The guide arrangement 44 may be arranged at the bottom 28 of the tank 20, as illustrated, or at a side of the tank 20 at the bottom end portion of the tank 20.

In these embodiments, the guide arrangement 44 comprises a protruding member 46 extending in parallel with the longitudinal axis 42 and being connected to the bottom 28 of the tank 20, and a recess forming arrangement 48 connected to the floor of the compartment 32. The protruding member 46 extends into a recess of the recess forming arrangement 48. Thus, the tank 20 is stabilised in lateral directions at its bottom end portion. The protruding member 46 has a length such that it extends into the recess of the recess forming arrangement 48, also when the tank 20 is in its shortest state, i.e. when filled with liquefied hydrocarbon gas.

The tank 20 comprises at least one projection 50. The at least one projection 50 is arranged to transfer the weight of the tank 20 to the deck member 18. In this manner the tank 20 is suspended by the at least one projection 50 from the deck member 18. The at least one projection may comprise for instance, a flange or rim extending at least partially around the tank 20. Alternatively, the at least one projection may comprise a number of singular projections extending radially outwardly from the tank 20. The tank 20 comprises at least one protuberance 52 extending underneath the deck member 18. In this manner the tank may be prevented from floating up through the deck member 18 in case a compartment containing the tank 20 below the deck member 18 should be filled with water. Similarly, the tank 20 may be maintained in its position in relation to the deck member 18, should the floating vessel 2 capsize. The at least one protuberance 52 may comprise for instance, a flange or rim extending at least partially around the tank 20. Alternatively, the at least one protuberance 52 may comprise a number of singular protuberances extending radially outwardly from the tank 20. A seal is arranged between the tank 20 and the upper side 22 of the deck member 18. In these embodiments the seal comprises a sheet metal skirt 54 welded to the tank 20 and the deck member 18. In this manner water may be prevented from leaking from the upper side 22 of the deck member 18 along the tank 20 to below the deck member 18. Any type of seal achieving this may be used, such as the sheet metal skirt 54, or an elastic seal arranged between a flange of the tank 20 and the deck member 18.

The floating vessel 2 comprises at least one pipe 30 connected to the tank 20 above the upper side 22 of the deck member 18. The at least one pipe 30 may be a pipe for conducting liquefied gas or gas to and/or from the tank 20. At least one of the pipes 30 may be connected to a bunkering station 56 for refilling the tank 20 with liquefied hydrocarbon gas. Other pipes 30 may be arranged for conducting gas and/or liquefied gas to a gas consuming unit in the floating vessel 2.

The upper side 22 of the deck member 18 adjacent to the tank 20 is contiguous with an ambient environment of the floating vessel 2. The space around the top 26 of the tank 20 is open towards a sea side of the platform 4, i.e. a portion of the deck member 18 forms a balcony. In this manner the top 26 of the tank 20 is naturally ventilated. Moreover, also the bunkering station 56 arranged on the balcony is naturally ventilated.

The deck member 18 forms a lower deck, above which lower deck one or more higher level decks extend. Thus, the space around the top 26 of the tank 20 is laterally open towards a sea side of the platform 4. In alternative embodiments it is foreseen that at least one further lower deck extends below the deck member 18.

The floating vessel 2 is a semi-submersible offshore platform 4 comprising one or more submersible pontoons 6, at least two columns 8 (one of which is shown). The semi-submersible offshore platform 4 further comprises a body structure 3 comprising a deck structure 14 adapted to be arranged above a water surface. In these embodiments, the deck structure 14 comprises the deck member 18 which forms a lower deck, a tween deck 58, and a 20 main deck 60. Depending on the type of platform, various devices and forms of equipment may be arranged on the main deck 60.

The floating vessel 2 comprises a tunnel 40 extending through the deck structure 14. The tunnel 40 is arranged in open connection to an ambient environment of the floating vessel 2. In these embodiments the tunnel 40 connects to the ambient environment of the floating vessel 2 via the space comprising the top 26 of the tank 20 and the bunkering station 56. That is, a first opening 41 of the tunnel 40 at a first side portion 43 of the floating vessel 2 is arranged in open communication with the space comprising the top 26 of the tank 20. Pipes leading to and/or from the tank 20, and/or a further tank, and/or a gas consuming unit aboard the floating vessel 2 extend through the tunnel 40. For instance a liquefied gas pipe 62 may extend from the bunkering station 56 to the further tank via the tunnel 40. In this manner both the tank 20 and the further tank may be filled from the same side of the floating vessel 2. Thus, a ship carrying liquefied hydrocarbon gas may fill both tanks only boarding one side of the floating vessel 2.

An inclined plate member 64 is arranged beneath the pipes 30, 62 in the space comprising the top 26 of the tank 20 and the bunkering station 56. The inclined plate member 64 is inclined downwardly to outside the floating vessel 2. Thus, should a pipe 30, 62 or a connection to the tank 20 or the bunkering station 56 rupture, liquefied gas will be conducted via the inclined plate member 64 to outside the floating vessel 2 instead of damaging the floating vessel 2. The inclined plate member 64 may connect to an inclined surface inside the tunnel 40.

Figure 5:
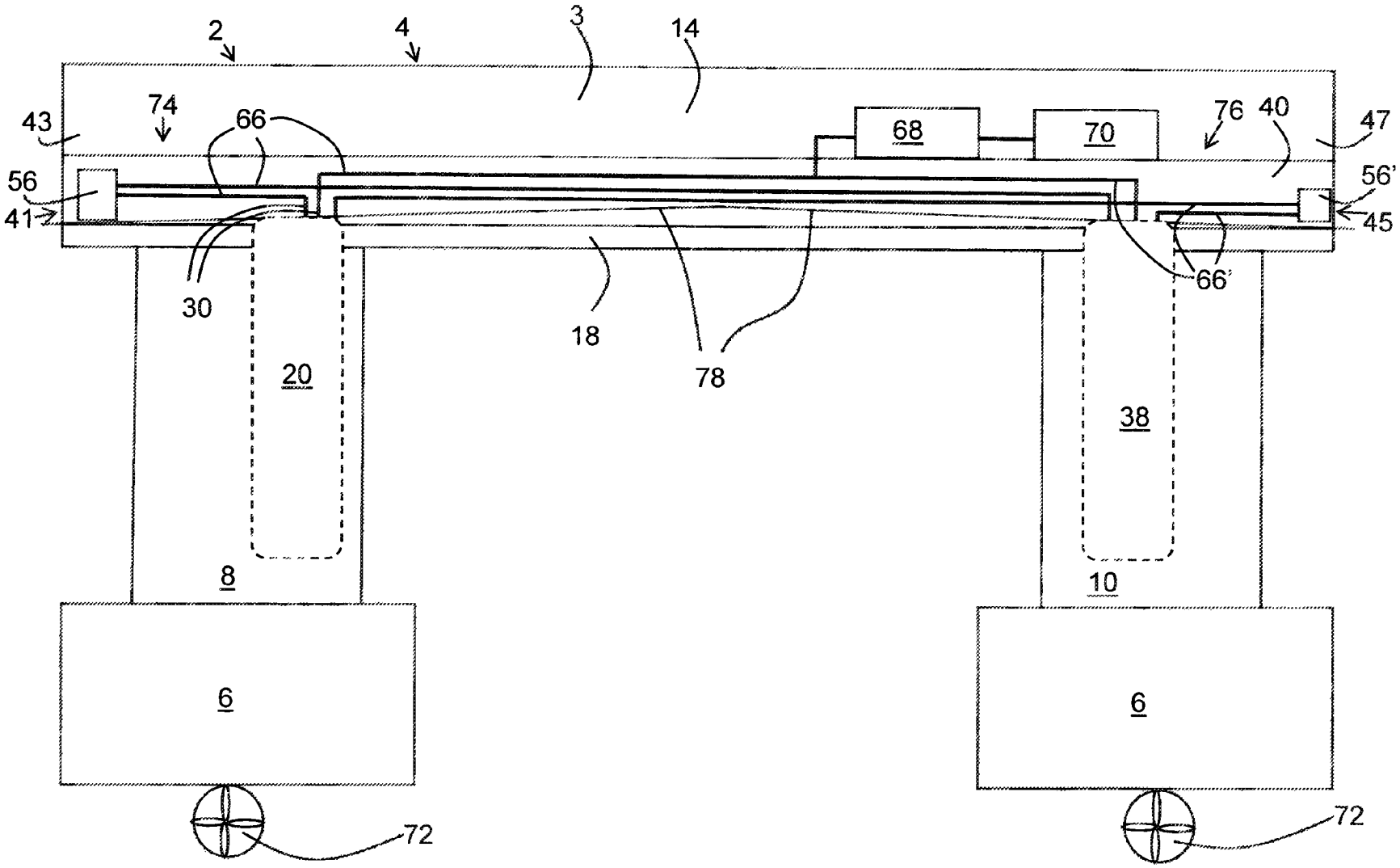

FIG. 5 schematically illustrates a front view cross section of embodiments of a floating vessel 2 in the form of a semi-submersible offshore platform 4. The semi-submersible offshore platform 4 comprises two submersible pontoons 6, a first column 8, a second column 10, and further columns, not shown. The semi-submersible offshore platform for may comprise up to eight columns. The semi-submersible offshore platform 4 further comprises a body structure 3 comprising a deck structure 14 adapted to be arranged above a water surface. The columns 8, 10 are connected to the one two submersible pontoons 6. The deck structure 14 comprises a deck member 18.

The semi-submersible offshore platform 4 comprises a tank 20 for liquefied hydrocarbon gas. The tank 20 extends through the deck member 18. The tank 20 is supported by the deck member 18. Again, the tank 20 may be suspended at less than ⅓ of a total height of the tank 20, seen from the top of the tank 20.

At least one pipe 30 is connected to the tank 20 above the upper side 22 of the deck member 18. The at least one pipe 30 may be a pipe for conducting liquefied gas or gas to, and/or from, the tank 20.

The tank 20 is at least partially arranged in the first column 8. The floating vessel 2 comprises a further tank 38 for liquefied gas. The further tank 38 is at least partially arranged in the second column 10. The floating vessel 2 comprises a tunnel 40 extending through the deck structure 14. The tunnel 40 is arranged in open connection to an ambient environment of the semi-submersible offshore platform 4 The tunnel 40 has a first opening 41 at the first end portion 74 and a first side portion 43 of the body structure 3. The tunnel 40 has a second opening 45 at the second end portion 76 and a second side portion 47 of the body structure 3. Pipes 66 leading to and/or from the tank 20 and the further tank 38 extend through the tunnel 40. Thus, the pipes 66 for liquefied gas or gas are arranged in a ventilated environment.

The semi-submersible offshore platform 4 comprises an engine 68 and or other gas consumer 70. The tank 20 may be a dedicated fuel tank for the engine 68 and/or other gas consumer 70. The engine 68 may be an engine for directly or indirectly propelling the floating vessel and/or an engine for driving an electric generator. The semi-submersible offshore platform 4 may comprise electrically powered thrusters 72. Such thrusters 72 may be used for maintaining a stable platform position if the semi-submersible offshore platform 4 is not anchored to the bottom of the sea, and/or for propelling the semi-submersible offshore platform 4.

At least one pipe 66 leading from the tank 20 and/or the further tank 38 to the engine 68 and/or the other gas consumer 70 extends through the tunnel 40.

As illustrated in FIG. 5, from a first end portion 74 of the tunnel 40 pipes 66 lead to and/or from the tank 20 and the further tank 38, as well as from the tank 20 to the engine 68 and/or other gas consumer 70. Also illustrated is a bunkering station 56 arranged in vicinity of the first end portion 74 of the tunnel 40. At least one pipe 66 leads from the bunkering station 56 to the further tank 38. A similar arrangement is provided at a second end portion 76 of the tunnel 40. That is, in the tunnel 40 there are arranged pipes 66' leading from the second end portion 76 to and/or from the further tank 38 and the tank 20, as well as from the further tank 38 to the engine 68 and/or other gas consumer 70. A further bunkering station 56' is arranged in vicinity of the second end portion 76 of the tunnel 40. At least one pipe 66' leads from the further bunkering station 56' to the tank 20. In this manner both the tank 20 and the further tank 38 may be filled from the same side of the floating vessel 2. Thus, a ship carrying liquefied hydrocarbon gas may fill both tanks 20, 38 by only having to board one side of the semi-submersible offshore platform 4, preferably a leeward side.

The tunnel 40 comprises an inclined surface 78 arranged beneath the pipes 66, 66' in the tunnel 40. The inclined surface 78 is inclined downwardly towards an end portion of the tunnel 40. In these embodiments, the inclined surface 78 has been illustrated inclined downwardly towards both end portions 74, 76 of the tunnel 40. The inclined surface 78 is inclined downwardly to outside the semi-submersible offshore platform 4. Thus, should a pipe 66, 66' rupture, liquefied gas will be conducted via the inclined surface 78 to outside the floating vessel 2 instead of damaging the floating vessel 2.

This invention should not be construed as limited to the embodiments set forth herein. A person skilled in the art will realize that different features of the described embodiments may be combined to create embodiments other than those described herein, without departing from the scope of protection, as defined by the appended claims. Although the description refers to example embodiments, many different alterations, modifications and the like will become apparent for those skilled in the art. For instance, illustrated embodiment of the tunnel 40 have a substantially straight extension through the body structure 3. Alternatively, the tunnel 40 may have a curved or other nonlinear extension. Therefore, it is to be understood that the foregoing is illustrative of various example embodiments and that the scope of protection is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A floating vessel, comprising:

one or more submersible pontoons, a first column, and a deck, wherein the first column is connected to the deck and at least one of the one or more submersible pontoons;

a tank for at least temporarily storing a liquid, wherein the tank is at least partially arranged in the first column;

at least one pipe connected to the tank; and a tunnel having a first end portion and a second end portion extending through the deck, the tunnel having a first opening at the first end portion and at a first side portion of the deck, and a second opening at the second end portion and at a second side portion of the deck, wherein the at least one pipe connected to the tank extends at least partially through the tunnel.

2. The floating vessel according to claim 1, wherein the tank is adapted for at least temporarily storing liquefied hydrocarbon gas.

3. The floating vessel according to claim 1, comprising a further tank for at least temporarily storing a liquid and at least one pipe connected to the further tank, wherein the at least one pipe connected to the further tank extends through the tunnel.

4. The floating vessel according to claim 1, comprising an engine and/or other gas consumer and a pipe leading from the tank to the engine and/or the other gas consumer, wherein the pipe leading from the tank to the engine and/or the other gas consumer extends through the tunnel.

5. The floating vessel according to claim 4, wherein the tank is a dedicated fuel tank for the engine and/or the other gas consumer.

6. The floating vessel according to claim 1, wherein the tunnel comprises an inclined surface arranged beneath the at least one pipe in the tunnel, the inclined surface being inclined downwardly towards the first end portion and/or the second end portion of the tunnel.

7. The floating vessel according to claim 1, comprising a bunkering station for filling the tank, the bunkering station being arranged in vicinity of the first end portion of the tunnel.

8. The floating vessel according to claim 3, comprising a bunkering station for filling the further tank, the bunkering station being arranged in vicinity of the second end portion of the tunnel, wherein the at least one pipe connected to the further tank is connected to the further bunkering station.

9. The floating vessel according to claim 1, wherein the tank extends through the deck member, and wherein the tank is supported by the deck.

10. The floating vessel according to claim 9, wherein the tunnel connects to a space adjacent to the tank.

11. The floating vessel according to claim 1, further comprising a second column, wherein the deck structure is adapted to be arranged above a water surface, and wherein the second column is connected to the deck and at least one of the one or more submersible pontoons.

12. The floating vessel according to claim 1, comprising a further tank for at least temporarily storing a liquid and at least one pipe connected to the further tank, wherein the at least one pipe connected to the further tank extends through the tunnel, and wherein the further tank is at least partially arranged in the second column.

13. A floating vessel, comprising:

one or more submersible pontoons, a first column, a second column, and a deck, wherein the first column and the second column connect the deck to at least one of the one or more submersible pontoons;

a tank at least partially located in the first column, wherein the tank is adapted to store a liquid;

a tunnel extending through the deck, the tunnel having a first opening at a first side of the deck and a second opening at a second side of the deck; and at least one pipe connected to the tank, wherein the at least one pipe extends at least partially through the tunnel.

14. The floating vessel according to claim 13, further comprising a second tank at least partially located in the second column.

15. The floating vessel according to claim 13, further comprising a second tank at least partially located in the second column and at least one second pipe connected to the second tank, wherein the at least one second pipe extends at least partially through the tunnel.

16. The floating vessel according to claim 13, wherein an inclined surface is located beneath the at least one pipe in the tunnel.

17. The floating vessel according to claim 13, wherein an inclined surface is located beneath the at least one pipe in the tunnel, and wherein the inclined surface slopes away from the deck and toward the first end of the tunnel, the second end of the tunnel, or both the first end of the tunnel and the second end of the tunnel.

18. The floating vessel according to claim 13, further comprising a bunkering station located within the tunnel, wherein the at least one pipe connected to the tank is connected to the bunkering station.

19. The floating vessel according to claim 13, further comprising:

a bunkering station located within the tunnel;

a second tank at least partially located in the second column; and at least one second pipe that extends at least partially through the tunnel and is connected to the second tank, wherein the at least one pipe connected to the tank and the at least one second pipe connected to the second tank are also each connected to the bunkering station.

20. A floating vessel, comprising:

one or more submersible pontoons, a first column, a second column, and a deck, wherein the first column and the second column connect the deck to at least one of the one or more submersible pontoons;

a first tank at least partially located in the first column;

a second tank at least partially located in the second column;

a tunnel extending through the deck, the tunnel having a first opening at a first side of the deck and a second opening at a second side of the deck;

a first pipe connected to the first tank, wherein the first pipe extends at least partially through the tunnel;

a second pipe connected to the second tank, wherein the second pipe extends at least partially through the tunnel; and an inclined surface located beneath the first pipe in the tunnel, wherein the inclined surface slopes away from the deck and toward the first end of the tunnel, the second end of the tunnel, or both the first end of the tunnel and the second end of the tunnel.

* * * * *